US007255136B2

(12) United States Patent
Templet et al.

(10) Patent No.: US 7,255,136 B2
(45) Date of Patent: Aug. 14, 2007

(54) PACKING VENT RECOVERY SYSTEM AND METHOD

(75) Inventors: Robert J. Templet, LaGrange, KY (US); Ernest B. McCurdy, LaGrange, KY (US)

(73) Assignee: Delaware Capital Formation, Inc., Wilmington, DE (US)

( * ) Notice: Subject to any disclaimer, the term of this patent is extended or adjusted under 35 U.S.C. 154(b) by 270 days.

(21) Appl. No.: 10/928,700

(22) Filed: Aug. 30, 2004

(65) Prior Publication Data

US 2006/0042719 A1 Mar. 2, 2006

(51) Int. Cl.
*B65B 1/04* (2006.01)

(52) U.S. Cl. ..... 141/59; 141/286; 141/9; 141/100

(58) Field of Classification Search ..... 141/9, 141/100, 286, 59, 67, 86, 311 A, 98; 264/37.1; 137/888, 892, 893
See application file for complete search history.

(56) References Cited

U.S. PATENT DOCUMENTS 3,817,265 A 6/1974 Ambler
5,137,547 A * 8/1992 Chretien ..... 95/55
5,213,725 A * 5/1993 Lee et al. ..... 264/37.16
5,229,043 A * 7/1993 Lee ..... 264/37.16
5,465,746 A 11/1995 Ebbing
5,467,705 A 11/1995 Daniel et al.
5,516,119 A 5/1996 Trackwell et al.
5,623,870 A 4/1997 Daniel
6,152,158 A 11/2000 Hu
6,315,000 B1 11/2001 Goodyear
6,418,957 B1 7/2002 Goodyear
2002/0043289 A1 4/2002 Goodyear

* cited by examiner

*Primary Examiner*—Steven O. Douglas
(74) *Attorney, Agent, or Firm*—Berenato, White & Stavish

(57) ABSTRACT

A gas recovery system designed to recover vent gas emanating from a gas processing system and return the gas to the processing system. The gas recovery system includes a pressurized motive gas that is directed through a vacuum generating apparatus. The vacuum suctions the vent gas into the vacuum generating apparatus and mixes the vent gas with the motive gas to create a mixed gas stream. The mixed gas stream is transported away from the vacuum generating apparatus by a mixed gas outlet line. A vent gas pressure regulator is fluidly connected between the vent gas supply line and the mixed gas outlet line. The vent gas pressure regulator maintains the vent gas supply line pressure above a predetermined pressure.

35 Claims, 5 Drawing Sheets

PACKING VENT RECOVERY SYSTEM AND METHOD

FIELD OF THE INVENTION

The present invention relates to a gas recovery and re-injection method and apparatus. Specifically, the invention relates to a system for recovering gas emanating from the seals of a reciprocating gas compressor.

BACKGROUND OF THE INVENTION

The prior art includes various systems designed to recover unpreassurized excess gas (i.e. "vent gas") for re-injection or collection. In earlier gas processing systems, vent gas was either ignored, burned-off as a flare, or vented to the atmosphere away from the main processing system. Although these methods are relatively inexpensive, they have adverse environmental impacts and may create a safety hazard.

Some existing and prior-art systems use electrical power to vacuum vent gas from a low pressure or gas leakage area and pump the gas back into a host system. While these systems are effective, they require a source of electrical power and an electrical pumping mechanism, which could fail and/or create a safety hazard. Other systems have a separate dedicated mechanical compressor that scavenges, pressurizes and re-injects the vent gas back into the host system. Both of these types of systems are relatively complex and employ comparatively elaborate sensing and pumping mechanisms with multiple moving parts.

More recently gas recovery systems have been introduced that direct a relatively high pressure gas (known as "motive gas") through a vacuum generating apparatus, such as a jet compressor, to create a vacuum. The vacuum is then used to suction the vent gas into the jet compressor. The suctioned gas is mixed with the motive gas to create a mixed gas stream, which is then injected back into the system. Although these systems do not require electrical or mechanical pumping mechanisms, they lack a simple and effective control system to maintain the various pressures and flow rates within predetermined limits and prevent the entry of air into the system.

The gas that is being processed preferably is recovered for the above reasons. Recovery of the gas requires that contamination be minimized, in order to preserve subsequent usability of the gas and also due to costs. Natural gas, for example, is priced based upon BTU value. Should the natural gas be contaminated during the recovery process with air, then the BTU value of the gas will be reduced and its value lowered. Other gases which are to be reacted, for example, should have minimal contamination in order to preserve reactivity.

The need exists for a self-contained gas recovery method and apparatus that has a reliable pressure regulating capability. The present invention provides a gas recovery system that includes a self-powered gas recovery device with no moving parts. The invention has a pressure regulation system that continuously monitors and adjusts a jet compressor inlet vent gas supply line pressure to ensure that the pressure in the vent gas supply line does not go below a pre-defined pressure, and thereby allow air gas to enter the system.

SUMMARY OF THE INVENTION

The present invention is a gas recovery system comprising a vent gas supply line for transporting a vent gas, and a motive gas supply line for transporting a motive gas. The motive gas and vent gas are directed through a vacuum generating apparatus so that a vacuum is generated. The vacuum suctions the vent gas into the vacuum generating apparatus and mixes the vent gas with the motive gas to create a mixed gas stream. The mixed gas stream is transported away from the vacuum generating apparatus by a mixed gas outlet line. A vent gas pressure regulator is fluidly connected between the vent gas supply line and the mixed gas outline. The vent gas pressure regulator maintains the vent gas supply line pressure above a predetermined pressure.

The invention also comprises a gas recovery system operatively associated with a compressor. The system includes a compressor that leaks a vent gas and discharges a motive gas. A vent gas supply line transports the vent gas, and a motive gas supply line transports the motive gas. Both the motive gas and the vent gas are directed through a vacuum generating apparatus so that a vacuum is generated to suction the vent gas into the vacuum generating apparatus. The vent gas and the motive gas mix in the vacuum generating apparatus and thereby produce a mixed gas stream. The mixed gas stream is transported in a mixed gas outlet line. The pressure of the vent gas supply line is controlled by using a pressure regulator to direct the mixed gas through the pressure regulator and into the vent gas supply line if a pressure in the vent gas supply line pressure falls below a predetermined pressure. The mixed gas is then directed back into the compressor system.

The present invention also comprises a gas recovery system that includes a reciprocating compressor that discharges a motive gas and has a packing gland that is operatively associated with the compressor. The packing gland emanates a vent gas. The vent gas is transported by a vent gas supply line, and the motive gas is transported by a motive gas supply line. The vent gas supply line includes a liquid knockout vessel with a pressure relief valve. The motive gas supply line includes a motive gas pressure regulator and a filter mechanism that filters the motive gas before it reaches the pressure regulator. The system also includes a jet compressor that receives the vent gas supply line and the motive gas supply line. The motive gas is directed through a venturi nozzle in the jet compressor. The jet compressor generates a vacuum to suction vent gas from the packing gland into the jet compressor. The vent gas and the motive gas are mixed within the jet compressor to form a mixed gas. The mixed gas is transported away from the jet compressor by a mixed gas outlet line.

A directional flow valve is connected to the vent gas supply line between the liquid knockout vessel and the jet compressor. A vent gas supply line pressure monitoring apparatus is connected to the vent gas supply line between the directional flow valve and the liquid knockout vessel. A vent gas pressure regulator monitors the vent gas supply line pressure at the liquid knockout vessel. The vent gas pressure regulator regulates the pressure in the vent gas supply line so that when the vent gas supply line pressure goes below a predetermined pressure, the pressure regulator directs the mixed gas from the mixed gas outlet line through the vent gas pressure regulator to a mixed gas injection point on the vent gas supply line. The mixed gas injection point is positioned between the directional flow valve and the jet compressor. The pressure regulator causes the mixed gas to flow into the vent gas supply line so that the vent gas supply line pressure is moderated. The mixed gas that is not re-directed by the pressure regulator flows into a gas suction intake for the compressor.

The present invention also discloses a method for recovering vent gas from a gas processing operation. The vent gas is collected in a containment area associated with gas processing equipment. The vent gas is suctioned from the containment area by a vacuum generating apparatus. The vent gas is mixed with a motive gas that has been compressed by the gas processing equipment so that a mixed gas is produced. The mixed gas is then injected back into a lower pressure intake operatively associated with the gas processing equipment.

The present invention further discloses a method of recovering leaking vent gas from a gas compressor operation. Gas leaking from a compressor packing gland is contained in a gas containment area. Motive gas from the compressor is directed through a jet compressor to generate a vacuum. The vacuum created by the jet compressor is used to suction vent gas from the gas containment area through a vent gas supply line and into the jet compressor. In the jet compressor, the vent gas is mixed with the motive gas to create a mixed gas. The mixed gas is transported by a mixed gas outlet line. A pressure regulator controls the pressure in the vent gas supply line. When the pressure in the vent gas supply line falls below a predetermined pressure, the pressure regulator directs mixed gas from the mixed gas outlet line through the pressure regulator and into the vent gas supply line. The mixed gas produced by the process is injected back into an intake of the compressor.

DETAILED DESCRIPTION OF PREFERRED EMBODIMENTS

The present invention comprises a system designed to recover vent gas from a compressor 12. Specifically, the current invention is designed to recover gas emanating from the seals of a reciprocating gas compressor 12. The gas recovery device 10 of the invention maintains the pressure in a vent gas line sufficiently high to prevent ingress of air or other gaseous contaminants into the supply line.

Figure 1:
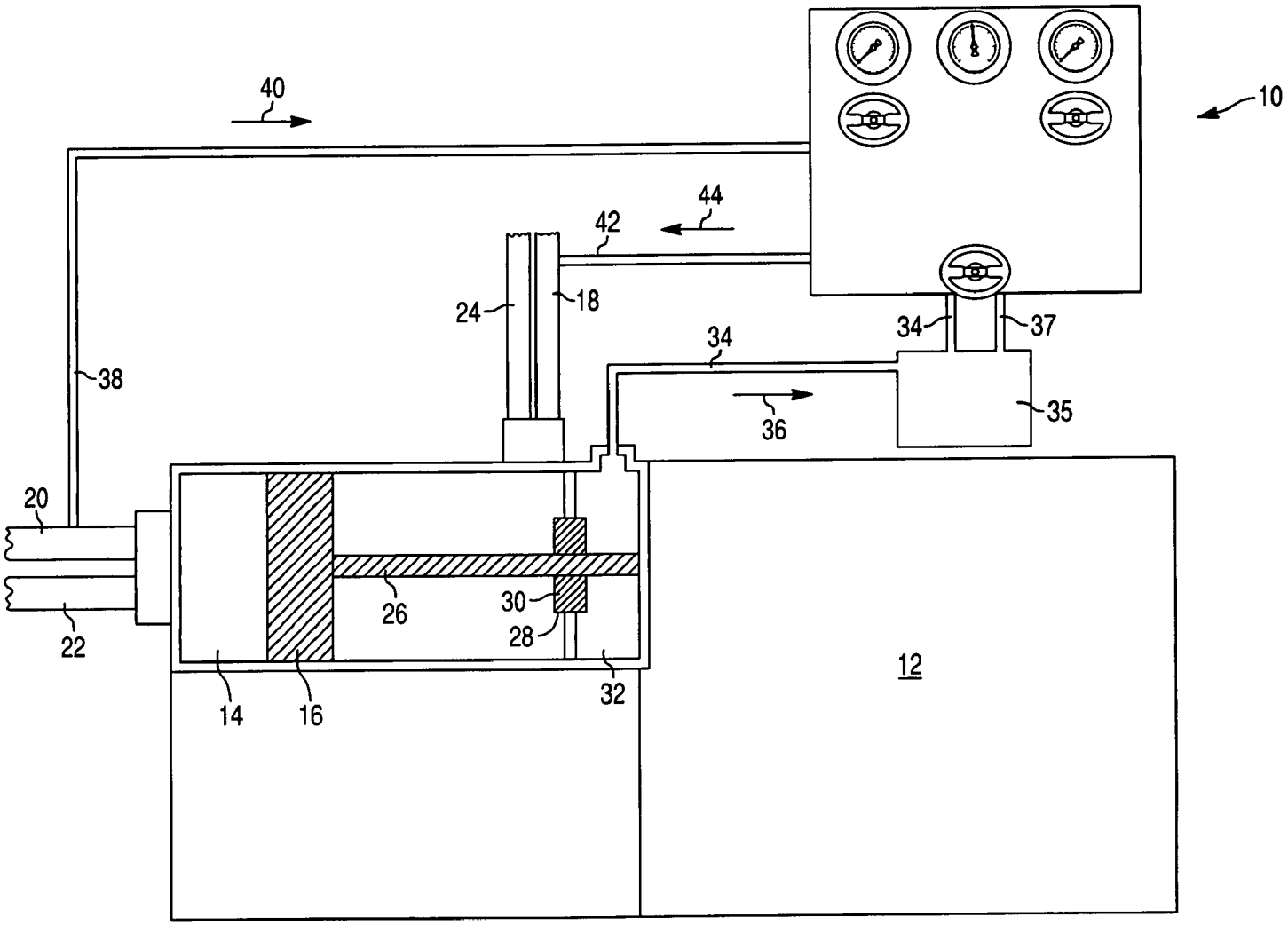
FIG. 1 is an elevational view of a compressor system according to the invention with portions shown in section of the gas compressor cylinder and associated equipment.

As best shown in FIG. 1, a reciprocating compressor 12 includes a gas compression cylinder 14 and a compressing piston 16. Gas, such as natural gas, is compressed within the cylinder 14 through the reciprocating movement of the piston 16. In the double-acting compressor 12 shown in FIG. 1, each time the piston 16 extends (moves to the left in FIG. 1), gas is suctioned into the compressor 12 through a suction line 18, and discharged through a discharge line 20. When the piston 16 retracts (moves to the right in FIG. 1), gas is suctioned into the cylinder 14 through a second suction line 22 and discharged through a second discharge line 24. A portion of the relatively high pressure discharged gas is directed to a motive gas supply line 38. The motive gas supply line 38 directs the motive gas to a gas recovery device 10.

The compressor piston 16 is driven by a piston rod 26 that extends through an aperture 28 in the wall of gas cylinder 14. A packing gland 30 seals the aperture 28 during compressor 12 operations. Although the packing gland 30 may initially function as an effective seal, as the packing gland 30 wears, an increasing amount of vent gas escapes through the packing gland 30. The escaping vent gas is collected in a gas containment area 32, such as provided by a surrounding housing.

As best shown in FIG. 1, both the motive gas and the vent gas are directed to the gas recovery device 10 of the present invention. The vent gas is transported to the gas recovery device 10 through a vent gas supply line 34 in the direction indicated by the arrow 36, and the motive gas is transported to the gas recovery device 10 through the motive gas supply line 38 in the direction of the arrow 40. The vent gas supply line 34 is connected to a liquid knockout vessel 35 positioned below the gas recovery device 10. A vent gas pressure sensing line 37 extends from the gas recovery device 10 to sense the pressure of the vent gas supply line 34 at the liquid knockout vessel 35. The motive gas and the vent gas are combined within the gas recovery device 10 in a manner discussed below to produce a "mixed gas". The mixed gas is transported away from the gas recovery device 10 through a mixed gas outlet line 42 in the direction indicated by the arrow 44. In the preferred embodiment, the mixed gas is directed into a compressor suction line 18.

Figure 2:
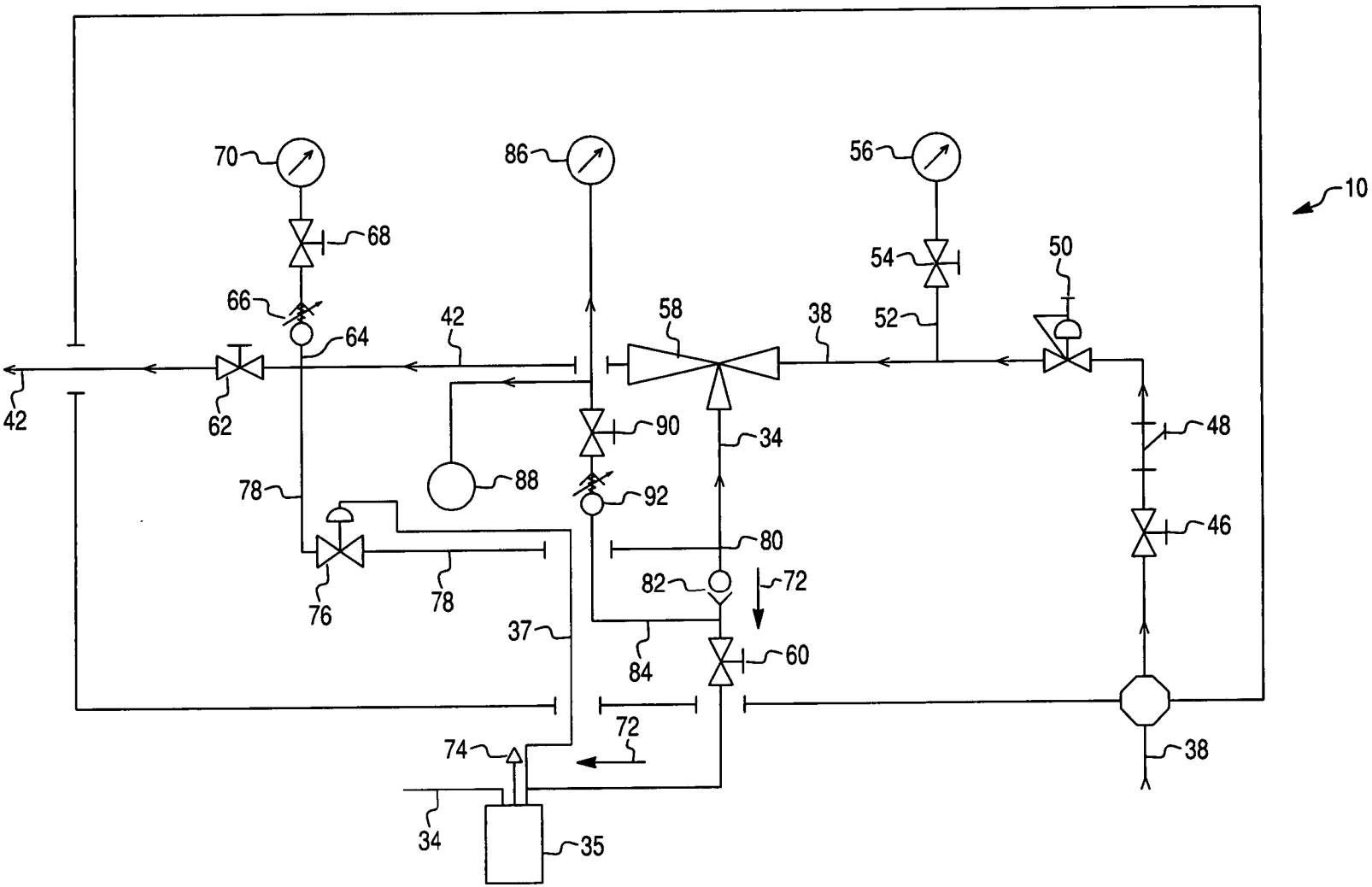
FIG. 2 is a schematic of the gas recovery device of the present invention.

As schematically shown in FIG. 2, the motive gas enters the gas recovery unit 10 through the motive gas supply line 38. The motive gas is directed through a motive gas supply line isolation valve 46 so that an operator can selectively isolate the motive gas from the gas recovery device 10. The motive gas then flows through a filter 48, preferably a "Y-strainer", and a motive gas pressure regulator 50 to ensure that all debris is removed from the gas and the motive gas is maintained at a constant pressure. A motive gas supply monitoring line 52 extends from the motive gas supply line 38. A motive gas pressure gauge 56 and a gauge isolation valve 54 are connected to the motive gas monitoring line 52.

The motive gas is then directed through a jet compressor-type eductor 58 having a venturi nozzle. When the relatively high-pressure motive gas is directed through the jet compressor 58, a vacuum is created in the attached vent gas supply line 34. The vacuum draws vent gas from the vent gas containment area 32 shown in FIG. 1, up through the vent gas supply line 34 and into the jet compressor 58. A vent gas supply line isolation valve 60 allows an operator to selectively cut-off the vent gas from the gas recovery device 10.

In the jet compressor 58, the relatively high-pressure motive gas is mixed with the low pressure vent gas to create a mixed gas having a pressure intermediate the motive gas and vent gas. The mixed gas is directed away from the jet compressor 58 through the mixed gas outlet line 42. A mixed gas isolation valve 62 and a mixed gas monitoring line 64 are connected to the mixed gas outlet line 42. The mixed gas isolation valve 62 allows an operator to selectively cut off the mixed gas leaving the gas recovery device 10. The mixed gas pressure gauge 70, a gauge saver 66 and a gauge isolation valve 68 are connected to the mixed gas monitoring line 64. As shown in FIG. 1, in the preferred embodiment, after leaving the gas recovery device 10, the mixed gas is directed back in to a suction intake line 18 for the compressor 12.

As best shown in FIGS. 1 and 2, the vent gas is drawn up through the vent gas supply line 34 to the liquid knockout vessel 35. Liquids that condense within the vent gas recovery device 10 are collected in the liquid knockout vessel 35. Liquids condensing within the jet compressor 58 are allowed to drain freely in the direction of the arrows 72. The liquid knockout vessel 35 also collects lubricating oils from the piston rod 26 and other liquids and debris associated with the operation of the compressor 10. The liquid knockout vessel 35 includes a pressure relief valve 74 that protects the system from over pressurization.

As best shown in FIG. 2, the pressure within the vent gas recovery device 10 is regulated by a vent gas pressure regulator 76. The pressure within the vent gas supply line 34 is sensed by the pressure regulator 76 through a sensing line 37 that extends from the pressure regulator 76 to the liquid knockout vessel 35. The vent gas pressure is measured at the liquid knockout vessel 35 because the liquid knockout vessel provides the largest volume sensing point within the vent gas system. When the pressure regulator 76 detects a vent gas supply line 34 pressure that is below a predetermined pressure, mixed gas is directed from the mixed gas outlet line 42 through a pressure regulation line 78 connected to the vent gas pressure regulator 76. The mixed gas is directed through the pressure regulator 76 and into the vent gas supply line 34 at a mixed gas injection point 80. The injected mixed gas raises the pressure in the vent gas supply line 34 above the predetermined minimum pressure to ensure that no air is ingested into the system. A vent gas supply line directional valve 82 prevents the injected mixed gas from flowing away from the jet compressor 58.

In the preferred embodiment, the vent gas pressure regulator 76 is a diaphragm-type regulator valve, and the directional valve 82 is a check valve, preferably a ball check valve. However, other types of pressure regulators and directional valves should be considered within the scope of the invention.

As best shown in FIG. 2, pressure within the vent gas supply line 34 is monitored by monitoring equipment in fluid communication with a vent gas monitoring line 84. A vent gas pressure gauge 86 is connected to the vent gas monitoring line 84 so that an operator can monitor visually the vent gas supply line 34 pressure. A remote transmitter 88 may also be attached to the vent gas monitoring line 84 so that the vent gas pressure may be monitored from remote locations. A gauge isolation valve 90, and a gauge saver 92 are also connected to the vent gas monitoring line 84. The vent gas monitoring line 84 is connected to the vent gas supply line 34 between the vent gas isolation valve 60 and the directional flow valve 82.

Figure 3:
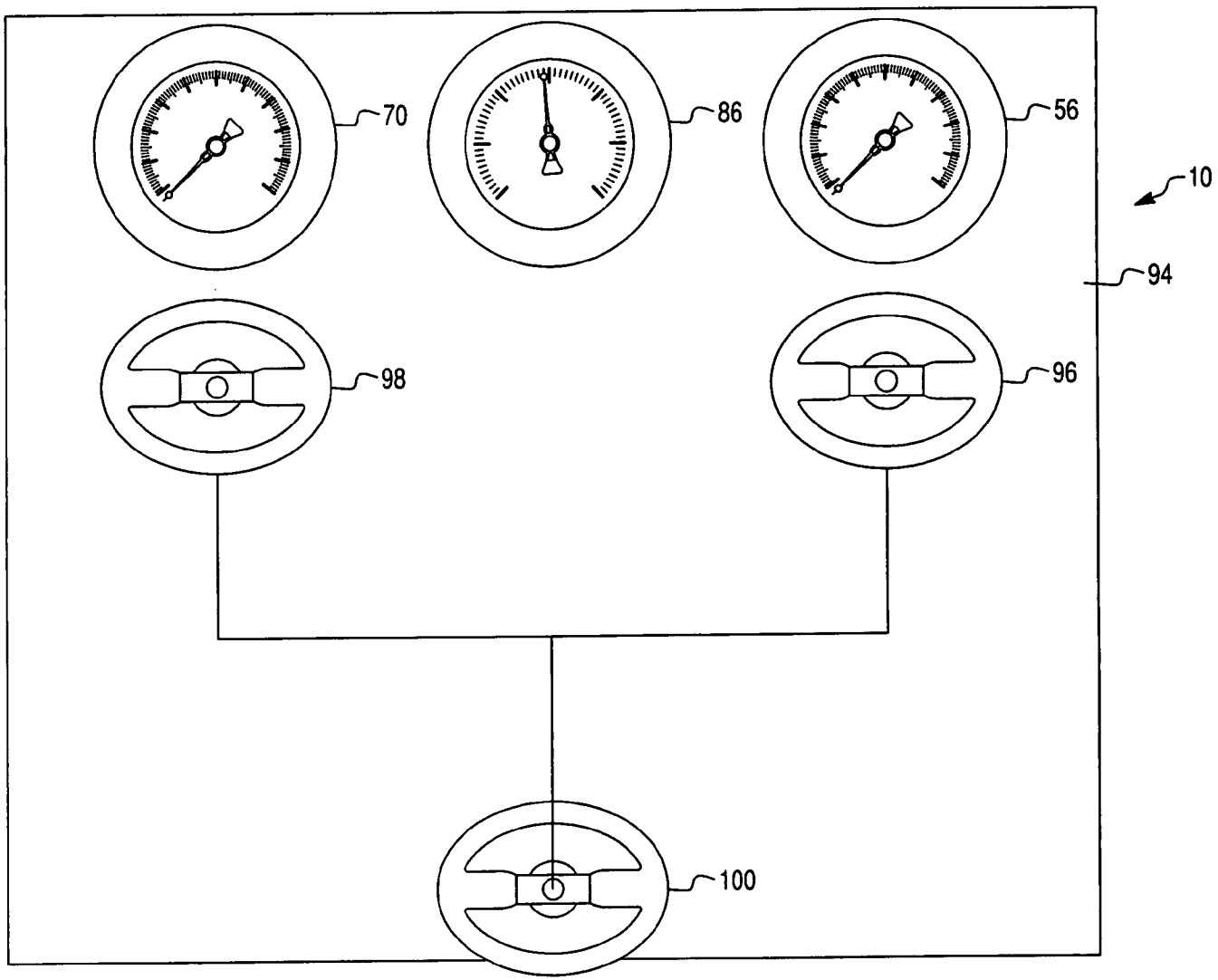
FIG. 3 is an elevational view of the front side of the gas recovery device.

As best shown in FIG. 3, the front face 94 of the housing containing the gas recovery device 10 includes the vent gas inlet supply line pressure gauge 86, the motive gas inlet supply line pressure gauge 56, and the mixed gas outlet line pressure gauge 70. Additionally the front face 94 also includes a valve control handle 96 for controlling the motive gas inlet supply line isolation valve 46, a valve control handle 98 for controlling the mixed gas outlet line isolation valve 62, and a control handle 100 for controlling the vent gas supply line isolation valve 60.

Figure 4:
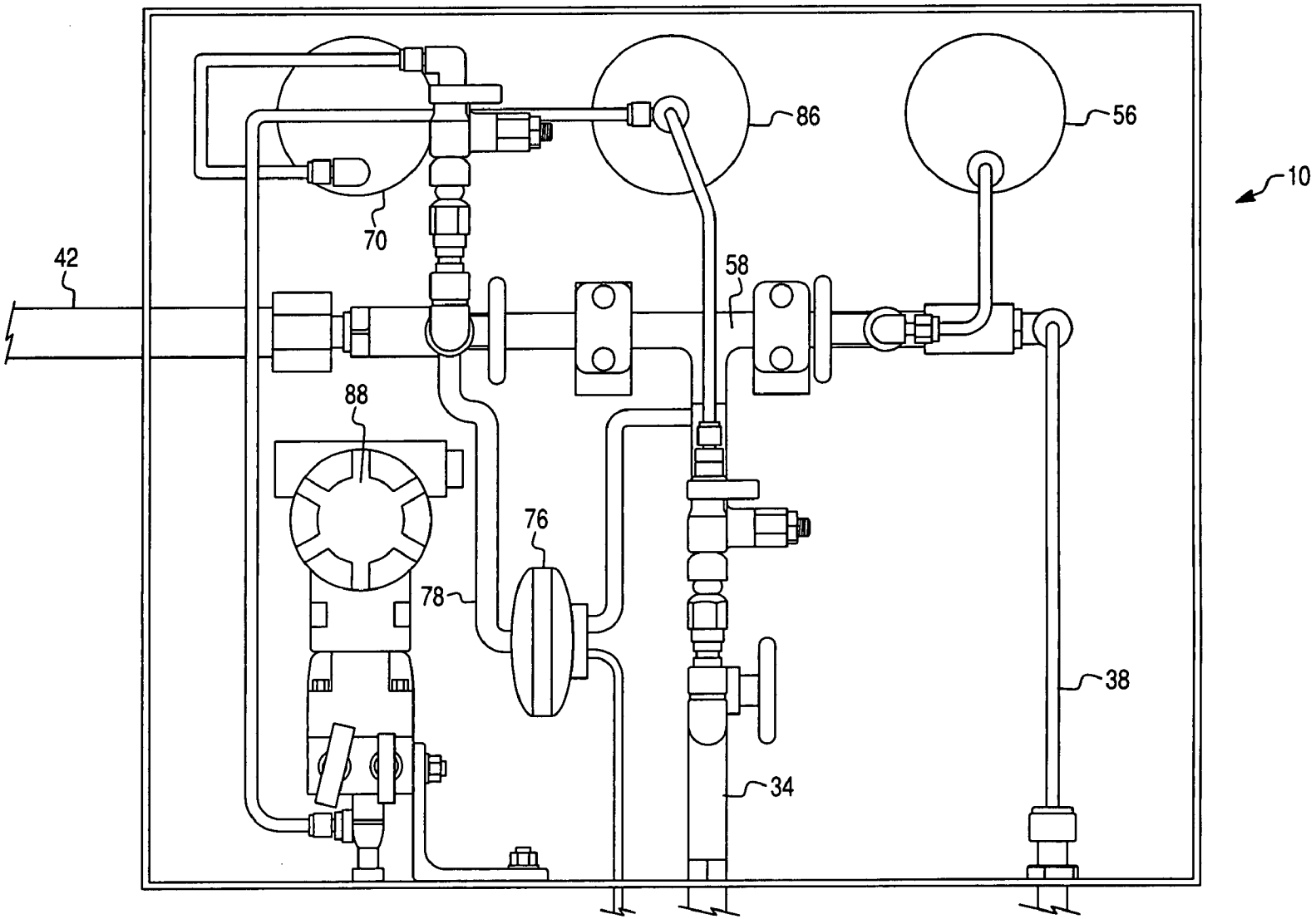
FIG. 4 is an elevational view of the rear of the gas recovery device.

FIG. 4 shows a rear view of the housing containing the gas recovery device 10. As shown in FIG. 4, the jet compressor 58 is positioned at the intersection of the motive 38, vent 34, and mixed gas 42 lines. As described above, the motive, vent, and mixed gas pressure gauges 56, 86, 70 monitor the pressure in their respective lines 38, 34, 42. A pressure transmitter 88 can also monitor the pressure of the vent gas inlet line 34. The vent gas pressure regulator 76 is in fluid communication with the mixed gas outlet line 42 and the vent gas inlet line 34. As described above, the vent gas pressure regulator 76 introduces mixed gas to the vent gas supply line 34, if needed, to maintain the vent gas supply line 34 pressure above a predetermined minimum pressure. Leakage past packing gland 30 is not necessarily at a constant rate, so the gas being suctioned through vent gas line 34 is not at a constant flow rate and the pressure regulator 76 therefore assures sufficient pressure in vent gas line 34 to prevent ingress of contaminants.

Figure 5:
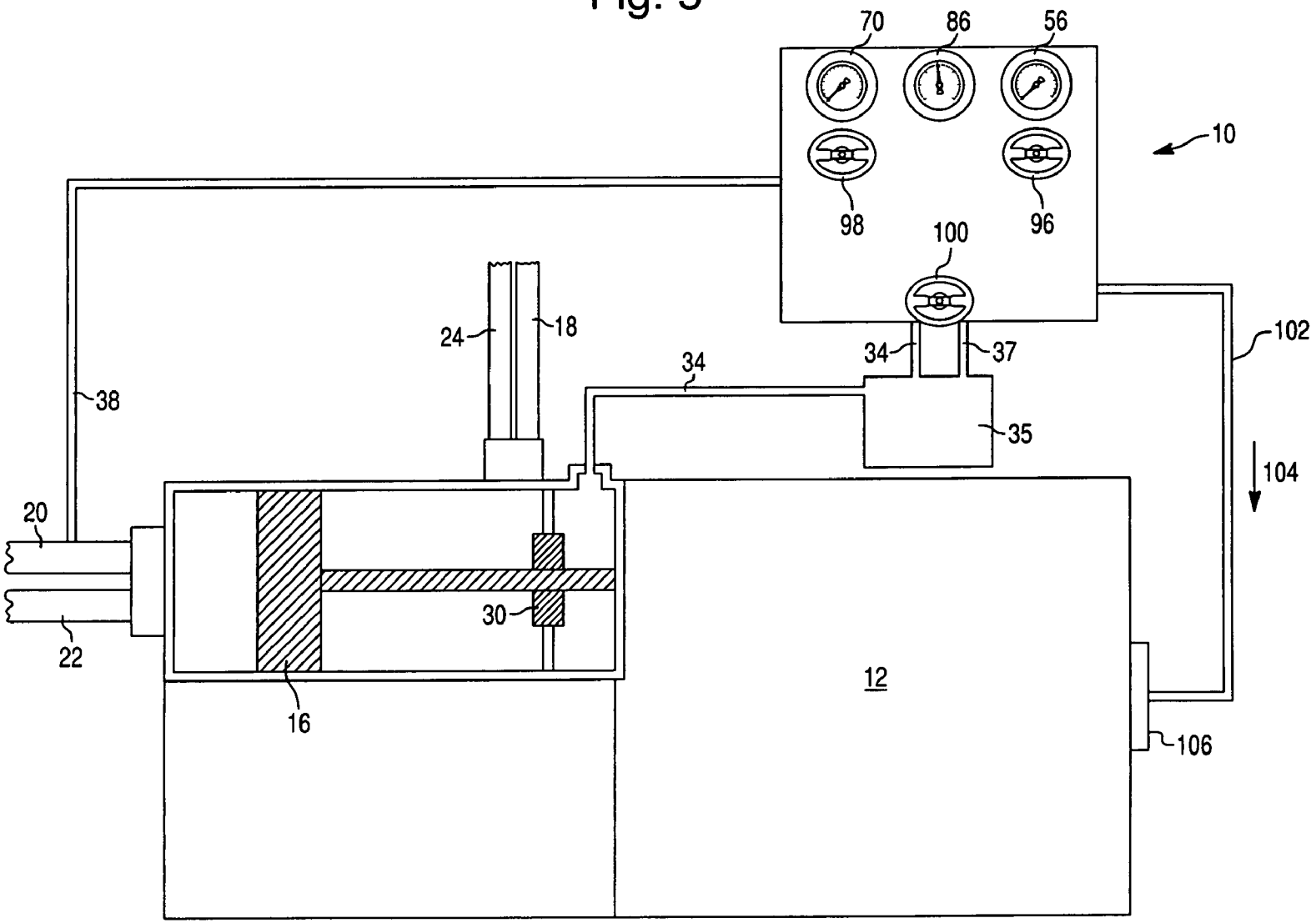
FIG. 5 is an elevational view of an alternative embodiment of the gas compressor system with portions shown in section of the gas compressor cylinder and associated equipment.

An alternative embodiment of the present invention is best shown in FIG. 5. The alternative embodiment is essentially identical to the preferred embodiment shown in FIG. 1, however, in the alternate embodiment, a mixed gas outlet line 102 directs mixed gas leaving the gas recovery device 10 in a direction indicated by the arrow 104. The mixed gas is directed into a fuel manifold 106 operatively associated with the compressor 12 so that the mixed gas is burned as fuel to power the compressor 12. Additional alternative embodiments may include other applications for the mixed gas flowing from the vent gas recovery device.

As best shown in FIGS. 1–4, in operation, a relatively high-pressure motive gas is discharged from a reciprocating compressor 12 and directed to a gas jet compressor 58 within a vent gas recovery device 10. A vacuum is generated within the jet compressor 58 to suction a low pressure vent gas from a gas containment area 32 operatively associated with a compressor packing gland 30. The collected vent gas is mixed with the motive gas within the jet compressor 58 to produce a mixed gas having a pressure intermediate the vent gas and the motive gas. The pressure of the vent gas supply line 34 is controlled by a pressure regulator 76. If the vent gas supply line pressure falls below a predetermined pressure, mixed gas is directed from a mixed gas outlet line 42 through the pressure regulator 76 and into the vent gas supply line 34, thereby moderating the pressure of the vent gas supply line 34. In the preferred embodiment, the mixed gas flowing from the mixed gas supply line 44 is directed into a suction intake line 18 for the compressor 12. In an alternative embodiment, the mixed gas is directed into a compressor fuel manifold 106.

The present invention may be modified in multiple ways and applied in various technological applications. The current invention may be modified and customized as required by a specific operation or application, and the individual components may be modified and defined, as required, to achieve the desired result. Although the materials of construction are not described, they may include a variety of compositions consistent with the function of the invention. Such variations are not to be regarded as a departure from the spirit and scope of the invention, and all such modifications as would be obvious to one skilled in the art are intended to be included within the scope of the following claims.

What is claimed is:

1. A gas recovery system, comprising:

a vent gas supply line for transporting a vent gas, a motive gas supply line for transporting a motive gas, a vacuum generating apparatus operatively associated with said vent gas supply line and said motive gas supply line, said motive gas being directed through said vacuum generating apparatus so that a vacuum is generated to suction the vent gas into said vacuum generating apparatus, the vent gas and the motive gas mixing in said vacuum generating apparatus to produce an outlet mixed gas stream, a mixed gas outlet line for transporting the mixed gas, and a vent gas pressure regulator in fluid communication with said vent gas supply line and said mixed gas outlet line for maintaining said vent gas supply line pressure above a predetermined pressure.

2. The system of claim 1 wherein said vent gas pressure regulator monitors said vent gas supply line pressure so that when said vent gas supply line pressure goes below the predetermined pressure, said vent gas pressure regulator directs the mixed gas from said mixed gas supply line through said vent gas pressure regulator and into said vent gas supply line at a mixed gas injection point, thereby moderating vent gas supply line pressure.

3. The system of claim 1 wherein said vent gas supply line includes a liquid knockout vessel.

4. The system of claim 3 wherein said vent gas pressure regulator monitors said vent gas supply line pressure at said liquid knockout vessel.

5. The system of claim 3 wherein said liquid knockout vessel includes a relief valve.

6. The system of claim 3 wherein said liquid knockout vessel collects a liquid condensing at said vacuum generating apparatus and a liquid condensing from the vent gas, said liquid knockout vessel further collecting lubricating oils and other debris associated with said system.

7. The system of claim 6 wherein:

said vent gas pressure regulator monitors said vent gas supply line pressure so that when said vent gas supply line pressure goes below the predetermined pressure, said vent gas pressure regulator directs the mixed gas from said mixed gas supply line through said vent gas pressure regulator and into said vent gas supply line at a mixed gas injection point, thereby moderating vent gas supply line pressure; and said vent gas supply line includes a directional flow valve positioned between said liquid knockout vessel and said mixed gas injection point.

8. The system of claim 7 wherein said vent gas supply line includes a vent gas supply line isolation valve positioned between said liquid knockout vessel and said directional flow valve.

9. The system of claim 8 wherein a vent gas pressure monitoring line extends from said vent gas supply line between said directional flow valve and said vent gas supply line isolation valve.

10. The system of claim 9 wherein a vent gas pressure monitoring line gauge saver, a vent gas pressure monitoring line isolation valve, and a vent gas supply line pressure gauge are connected to said vent gas pressure monitoring line.

11. The system of claim 10 further comprising a vent gas supply line pressure transmitter for transmitting said vent gas supply line pressure.

12. The system of claim 1 wherein said motive gas supply line includes a motive gas supply line isolation valve.

13. The system of claim 12 wherein said motive gas supply line includes a filter positioned between said vacuum generating apparatus and said motive gas supply line isolation valve.

14. The system of claim 13 wherein said filter is a "Y" strainer.

15. The system of claim 13 wherein said motive gas supply line includes a motive gas supply line pressure regulator positioned between said filter and said vacuum generating apparatus so that the motive gas has a constant pressure.

16. The system of claim 15 wherein said motive gas supply line includes a motive gas supply monitoring line.

17. The system of claim 16 wherein said motive gas supply monitoring line includes a motive gas supply monitoring line isolation valve and a motive gas supply line pressure gauge.

18. The system of claim 1 wherein a mixed gas outlet line isolation valve is connected to said mixed gas outlet line.

19. The system of claim 18 wherein said mixed gas outlet line includes a mixed gas outlet line monitoring line positioned between said mixed gas outlet line isolation valve and said vacuum generating apparatus.

20. The system of claim 1 wherein said vacuum generating apparatus is an eductor.

21. The system of claim 1 wherein said vacuum generating apparatus is a jet compressor.

22. The system of claim 21 wherein said jet compressor comprises a venturi nozzle, said motive gas being directed through said venturi to generate the vacuum.

23. The system of claim 22 further comprising a compressor.

24. The system of claim 23 wherein said compressor is a reciprocating compressor.

25. The system of claim 24 wherein said vent gas is suctioned from said compressor.

26. The system of claim 25 wherein said vent gas is suctioned from a packing gland operatively associated with said compressor.

27. The system of claim 23 wherein said motive has been discharged by said compressor.

28. The system of claim 23 wherein said mixed gas is directed into a gas intake of said compressor.

29. The system of claim 23 wherein said mixed gas is directed into a fuel intake for powering said compressor.

30. A compressor gas recovery system comprising:

a compressor discharging a motive gas and emanating a vent gas, a vent gas supply line for transporting the vent gas, a motive gas supply line for transporting the motive gas, a vacuum generating apparatus operatively receiving each of said vent gas supply line and said motive gas supply line, the motive gas being directed through said vacuum generating apparatus so that a vacuum is generated to suction the vent gas into said vacuum generating apparatus, the vent gas and the motive gas mixing in said vacuum generating apparatus to produce an outlet mixed gas stream, a mixed gas outlet line for transporting the mixed gas, a vent gas pressure regulator fluidly connected to said vent gas supply line and said mixed gas outlet line, said vent gas pressure regulator maintaining said vent gas supply line pressure above a predetermined pressure so that when said vent gas supply line pressure goes below the predetermined pressure said vent gas pressure regulator directs the mixed gas from said mixed gas outlet line through said vent gas pressure regulator and into said vent gas supply line thereby moderating said vent gas supply line pressure and preventing a vacuum in a containment area operatively associated with said compressor, the mixed that is not directed through said vent gas pressure regulator being directed back into said compressor gas recovery system.

31. The system of claim 30 wherein the mixed gas is directed into a gas suction intake of said compressor.

32. The system of claim 30 wherein the mixed gas is directed into a fuel system for said compressor.

33. A compressor gas recovery system comprising:

a reciprocating compressor discharging a motive gas, a packing gland operatively associated with said compressor, said packing gland leaking a vent gas, a vent gas supply line for transporting the vent gas, a liquid knockout vessel connected to said vent gas supply line, a relief valve connected to said liquid knockout vessel, a motive gas supply line for transporting said motive gas, a motive gas supply line pressure regulator connected to said motive gas supply line, a motive gas supply line pressure monitoring apparatus connected to said motive gas supply line, a filter connected to said motive gas supply line so that said motive gas is filtered before reaching said a motive gas supply line pressure regulator, a jet compressor operatively receiving each of said vent gas supply line and said motive gas supply line, said jet compressor comprising a venturi nozzle, said motive gas being directed through said venturi nozzle so that a vacuum pressure is generated to suction said vent gas from said packing gland and into said jet compressor, the motive gas and the vent gas being mixed within said jet compressor to produce a mixed gas stream, a mixed gas outlet line for transporting the mixed gas, a directional flow valve connected to said vent gas supply line between said liquid knockout vessel and said jet compressor, a vent gas supply line pressure monitoring apparatus connected to said vent gas supply line between said directional flow valve and said liquid knockout vessel, a vent gas pressure regulator sensing said vent gas supply line pressure at said liquid knockout vessel so that when said vent gas supply line pressure goes below a predetermined pressure, said vent gas pressure regulator directs the mixed gas from said mixed gas outlet line through said vent gas pressure regulator to an injection point on said vent gas line, said injection point being between said directional flow valve and said jet compressor, said vent gas pressure regulator causing the mixed gas to flow into said vent gas supply line so that said vent gas supply line pressure is moderated, the mixed gas also being directed into a gas suction intake for said compressor.

34. A method of recovering a leaking vent gas from a gas processing operation comprising the steps of:

providing a containment area associated with gas processing equipment, suctioning a vent gas from the containment area through the use of a vacuum generating apparatus, mixing the suctioned vent gas with a motive gas produced by the gas processing equipment to produce a mixed gas, injecting the mixed gas into a lower pressure intake operatively associated with the gas processing equipment.

35. A method of recovering vent gas emanating from a gas compressor operation comprising the steps of:

containing vent gas emanating from a compressor packing gland, providing a motive gas that has been compressed by the compressor, directing the motive gas through a jet compressor to generate a vacuum, using the vacuum generated by the jet compressor to suction the vent gas through a vent gas supply line and into the jet compressor, mixing the suctioned vent gas with the motive gas to create a mixed gas, transporting the mixed gas through a mixed gas outlet line, controlling the pressure of the vent gas supply line by using a pressure regulator to direct the mixed gas through the pressure regulator and into the vent gas supply line if a pressure in the vent supply gas line falls below a predetermined pressure, injecting the mixed not directed through the pressure regulator gas back into an intake of the compressor.

* * * * *